United States Patent [19]

Sauer

[11] 3,971,030

[45] July 20, 1976

[54] ANTENNA WINDOW

[75] Inventor: Gerd Sauer, Broichweiden, Germany

[73] Assignee: Saint-Gobain Industries, Neuilly-sur-Seine, France

[22] Filed: Oct. 1, 1974

[21] Appl. No.: 511,019

Related U.S. Application Data

[63] Continuation of Ser. No. 322,606, Jan. 11, 1973, abandoned.

[30] Foreign Application Priority Data

Jan. 14, 1972 France ..... 72.01249

[52] U.S. Cl. ..... 343/713; 343/744

[51] Int. Cl.[2] ..... H01Q 1/32

[58] Field of Search ..... 343/711, 712, 713, 744

[56] References Cited

UNITED STATES PATENTS 3,576,576 4/1971 Jensen ..... 343/712

3,771,159 11/1973 Kawaguchi ..... 343/713

*Primary Examiner*—Eli Lieberman

*Attorney, Agent, or Firm*—Pennie & Edmonds

[57] ABSTRACT

A combined window or windshield and antenna for an automotive vehicle includes an antenna comprising a generally T-shaped conductor and a generally U-shaped conductor, the two conductors being connected together at a point intermediate the ends of the U-shaped conductor, the two limbs of the U-shaped conductor so defined being asymmetric with respect to each other, whereby the resulting antenna has reception characteristics more nearly independent of the orientation of the vehicle to the transmitter whose signals are being received.

3 Claims, 11 Drawing Figures

ANTENNA WINDOW

This is a continuation of application Ser. No. 322,606, filed Jan. 11, 1973, now abandoned.

The present invention concerns a window pane or "window" with an antenna incorporated therein for an automotive vehicle. Such a combination is sometimes referred to as an antenna windshield or as an antenna window. In the combination of the invention, the antenna comprises a first conductor which is tuned in the frequency modulation band and a second conductor having two branches terminating in free ends. At a point situated between its two extremities the second conductor is coupled to the first, and the two conductors of the antenna are connected to a radio receiver in the vehicle by a common connecting element such as a lead, which may take the form of a coaxial cable.

It is known to place on a pane, e.g. an automobile windshield, a plurality of conductors to form an antenna, some of the conductors being intended to receive frequency modulated signals in the range, e.g. of 88 to 108 megaherz, and the others being intended to receive amplitude modulated signals, e.g. in the standard broadcast band of 525 to 1605 kiloherz. Thus there is described in the German Offenlegungsschrift No. 2,106,647 an antenna windshield in which a reactance is inserted into the conductor or conductors which have at least one free end. In this way, the part of the conductor situated between the reactance and the free end of the conductor is made inactive for the reception of signals in the frequency modulation band, and only the part of the conductor situated between the connecting element and the reactance (and, therefore, between the antenna terminal and the reactance), is effectively active in the frequency modulation band. On the other hand, in the amplitude modulation band, the reactance acts as a low-pass filter so that all parts of the conductor are active.

German Patent Application P. 21 45 96.7 describes an antenna windshield in which the antenna comprises two distinct principal conductors, one a central vertical conductor and the other a conductor having the form of a U disposed at the periphery of the windshield or window. These two conductors deliver their signals in phase and they feed the cable connecting the antenna to receiver directly through a common terminal disposed on the windshield.

The present invention provides an antenna window comprising two principal distinct branches or conductors as in German Patent Application P 21 45 98.7, both active in both the amplitude modulation and frequency modulation bands, and possessing improved reception characteristics.

In accordance with the invention, the second conductor of the antenna is also tuned in the frequency modulation band and is asymmetric with respect to the common terminal of the two conductors, i.e. with respect to the antenna terminal.

The asymmetry of the second conductor of the antenna can be introduced, for example, by coupling or inserting an inductance or a capacitance to or in one branch of that conductor. It is however particularly advantageous to obtain this asymmetry simply by a different geometry of the two branches of the second conductor of the antenna.

The present invention permits two distinct effects to be obtained. For one, the asymmetry of the second conductor of the antenna allows its impedance to be better adjusted. This shows itself in an increase in output voltage from the antenna independently of the orientation of the antenna (i.e. of the vehicle) with reference to the transmitter. In addition, this asymmetry importantly improves the reception in all directions. The latter effect may be explained as follows:

The characteristics of the conductors of antennas on motor car windows depend on the effect of the car body: It is therefore not possible to equate the properties of an isolated antenna to those of the same antenna mounted on a window of a car.

The following considerations apply to antenna windows mounted in the bodywork of a car: Known windshield antennas comprising vertical and horizontal conductor portions exhibit, once mounted in the bodywork, a certain directionality in the frequency modulation band. On the directional diagram of the antenna, there are generally minima lengthwise of the car and perpendicular thereto. These minima may be explained as follows:

When receiving electromagnetic waves which (as is now usual in FM broadcasting) are horizontally polarized, a vertical conductor of an antenna on the windshield of a car has two very pronounced minima when the car is aligned in the direction of the transmitter. In this direction the voltage produced by the antenna is only of the order of 10% of that obtained when the vehicle is aligned perpendicularly to the direction of the transmitter. On the other hand, when receiving horizontally polarized waves, a conductor of the antenna placed horizontally has two minima corresponding to the alignment of the car perpendicular to the direction of the transmitter. Thus, if there are combined in the antenna a horizontal conductor and a vertical conductor, the directional characteristics of the two conductors of the antenna are superposed. Such a window antenna should not, theoretically, show a minimum corresponding to alignement of the car with the direction of the transmitter: When such minima are observed, this is because the output voltage of the horizontal conductor is less than that provided by the vertical conductor.

In the majority of cases, the phenomenon is however more complicated. It is often difficult to dispose on the window conductors which are perfectly horizontal and perfectly vertical, and it is often necessary for the conductors to have curved portions.

In consequence, the central conductor generally has the shape of a T and the second conductor the shape of a U. The two conductors of the antenna have their respective advantages for different orientations of the car with respect to the transmitter. They do not have the pure directional characteristics of a perfectly vertical conductor or a perfectly horizontal conductor, but rather mixed characteristics. This explains why the pre-cut or pre-tuned U-shaped antenna conductor has, in addition to the minimum when the car is oriented in the direction of the transmitter, other minimum when the car is oriented in the direction of the transmitter.

In the present invention, it is possible to obtain a better tuning of the antenna conductors by proper positioning on pre-tuned antenna conductors of their points of connection to the antenna lead, or by effecting an electrical lengthening or shortening of the conductors by the provision of an inductance or capacitance as a part thereof. In the antennas of the prior art, tuning has been effected while retaining the symmetry of the system. The point of connection to the antenna lead has been at the center of the U-shaped conductor. This gives a low impedance and does not allow connection to the receiver under favorable conditions.

Along the length of a tuned conductor, the value of the impedance varies from a minimum at the center to a maximum at the ends. By moving the point of connection away from the middle it is thus possible to adjust the impedance at the connection point in order to obtain an optimum value for coupling to the receiver. Also, and this is one of the main advantages of the invention, the action of selected parts of the antenna can be rendered preponderant. It is also possible to give to the U-shaped conductor a directional characteristic approximately as good as that of a perfectly horizontal conductor. The energy received by the vertical portions of the conductor are thereby eliminated, but this is not important because in the position of the vehicle in which the central portion of the U-shaped conductor exhibits its optimum characteristics, the antenna voltage received by this central portion is amply sufficient.

The invention will now be described in more detail with reference to the annexed drawing, in which.

Figure 1:
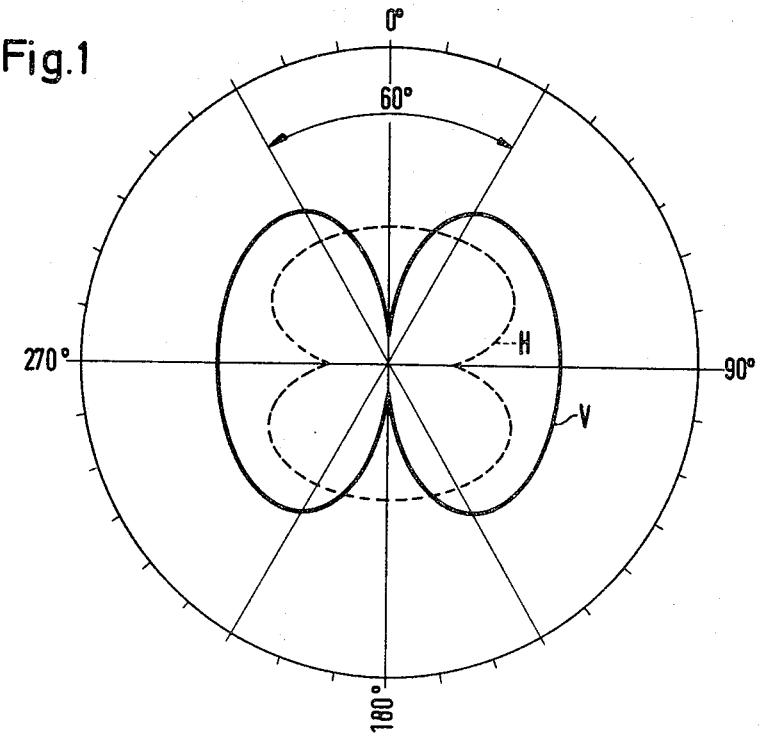
FIG. 1 is a plot of the directional properties of a vetical antenna conductor and of a horizontal conductor, both for horizontally polarized radiation.

FIG. 1 shows the directional diagram V of a vertical antenna conductor placed in the middle of a glass window or windshield and the directional diagram H of a horizontal antenna conductor of the same length, both situated on the windshield of an automobile. The indicated angles are the angles between the longitudinal axis of the vehicle and the direction of the transmitter. The transmitter is polarized horizontally; the diagram is plotted for frequencies in the frequency modulation band.

If the directional diagram V of a vertical antenna conductor is considered, it will be seen that the antenna voltage has practically the same value over segments aggregating some 240°. However when the car is positioned in the direction of the transmitter (or in the direction away therefrom), the antenna voltage has a very pronounced minimum and remains low for angles up to 10° on either side of this minimum. The directional diagram H of the horizontal antenna conductor has a shape similar to that of the diagram V but is displaced from the latter by an angle of 90°.

In the diagram H, the minimum values occur when the vehicle is perpendicular to the direction of the transmitter. The antenna voltage shown in diagram H has lower maxima than those of the vertical conductor, but the minima of diagram H are less pronounced than those of diagram V; features are due to the influence of the body of the car.

It should be understood that the directional diagrams can differ in detail from these ideal forms and according to the type of vehicle without, however, losing this characteristic general pattern. The differences arise essentially from differences in the vehicle bodies.

A windshield antenna having an ideal directional characteristic would comprise an antenna of T shape of which the vertical conductor and the horizontal conductor each have a length of λ/2 where λ is the wavelength of the radiation being received. For vertically polarized waves such an antenna has a length of 3λ/4. For waves in the horizontal direction, the horizontal part is operative with a length of λ/2. For such waves the vertical branch simply acts as a lead connected to the horizontal branch; because its length is suitably adjusted in advance, its own impedance does not play any part and if at the junction of the horizontal and vertical conductors the horizontal conductor displays a low resistance value, the antenna as a whole will similarly display a low resistance at the lower end of the vertical stub.

Figure 2:
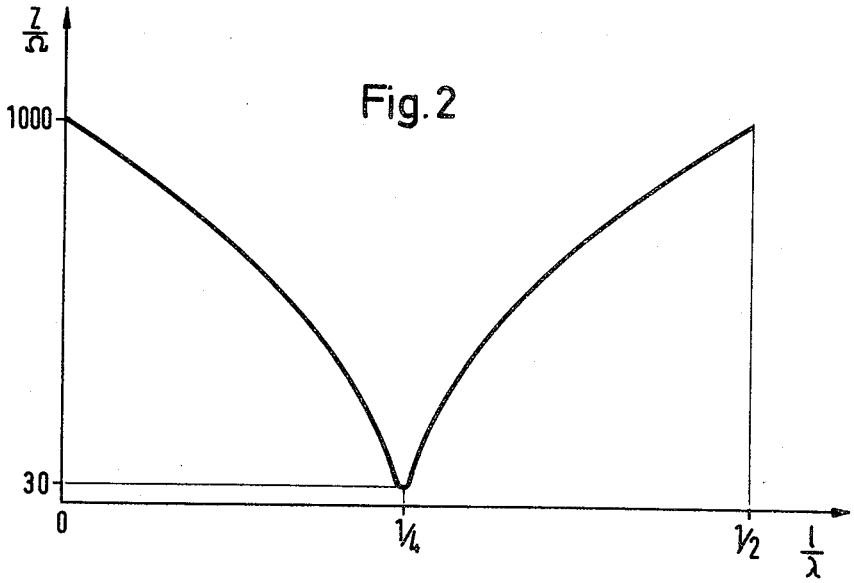
FIG. 2 is a diagram showing the variation of the impedance along a conductor of length λ/2.

As already mentioned, it is not possible to mount rectilinear conductors of this length on a normal windscreen of a passenger car: Neither the shape nor the ideal length of the conductors can be retained and this leads to a large directional effect for the resulting antenna. It will be recalled with reference to FIG. 2 how the impedance of an oscillating conductor, not having the improvement of the present invention, varies: The value of the impedance varies from a very high resistance value at the two ends of the conductor to a value of 30 ohms in the middle. It should be understood that these values are only real in the case of resonance. Consider such a conductor operating in resonance; its point of lowest resistance value is normally in its middle. If the point of connection is moved a certain distance to the right or left from the mid-point, the resistance of the antenna can be varied and an adjustment of the impedance can be obtained.

Figure 3:
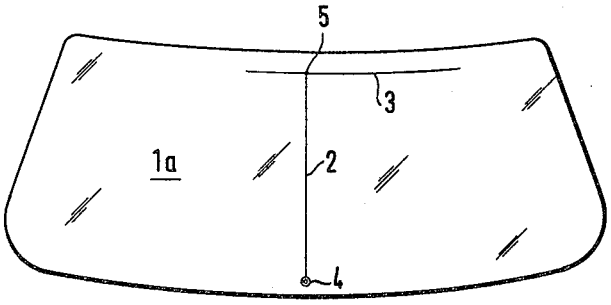
FIGS. 3 to 9 are diagrammatic views of different embodiments of the antenna window of the invention.

FIG. 3 shows a windscreen 1a comprising an antenna of T shape, improved according to the invention. The antenna is formed of a vertical conductor 2 and a horizontal conductor 3. At the foot of the vertical conductor 2 is disposed a connection element 4, constituting the antenna terminal. The vertical conductor has a length of λ/2. In order to calculate the exact length of the conductors, it is necessary to take account of the fact that the wavelength in the glass of the windshield or window 1a is not the same as in air, because the speed of propagation in glass is found by multiplying the speed of propagation in air by 0.3. But as part of the electric field is inside the glass, the factor to be used is from 1 to 0.39; it has been found experimentally that the value of the factor is 0.75 for a frequency of 100 MHZ. Using this correction factor there is calculated the length of the two antenna conductors 2 and 3, and a length of λ/2 is taken for the conductor 3. The point of junction 5 between the conductors 2 and 3 is chosen by moving it until it exhibits the same impedance as that seen at the foot of the antenna, i.e. at the internal 4, for example 150 ohms. This mode of construction frequently gives very good results. In the case where the electrical length of the vertical conductor 2 is too small, it can be lengthened for example by incorporating an inductance. The connecting cable can also be lengthened. This solution sometimes has the disadvantage of leading to a total conductor length which is too low for reception of amplitude modulated signals.

Figure 4:
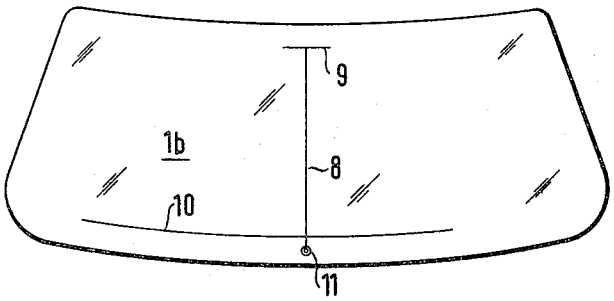

In the embodiment represented in FIG. 4 the antenna windshield comprises a vertical conductor 8 of length λ/4 itself having a horizontal conductor part 9 which allows the electrical length of the vertical conductor 8 to be adjusted by small adjustments in the length of the horizontal part 9; the part 9 of the conductor 8 cannot properly be considered as the horizontal conductor of the antenna. The true horizontal antenna conductor is constituted by the conductor 10, parallel to the lower edge of the windshield and of total length $\lambda/2$, which is connected to the conductor 8 at the foot 11 of the antenna. The exact location of this point of connection 11 of the conductor 10 to the conductor 8 is obtained when the minimum values on the directional diagram are raised as much as possible: The optimum impedance value is then obtained for the horizontal antenna conductor.

Figure 5:
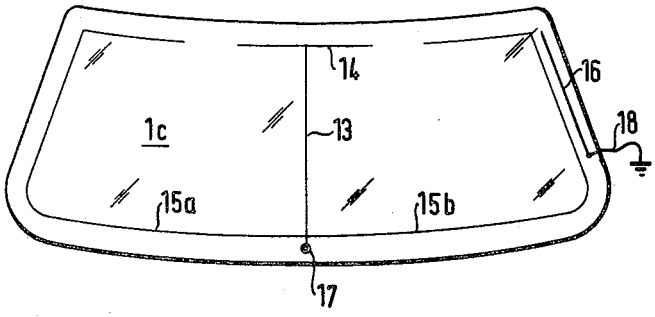

FIGS. 5 to 8 illustrate embodiments of the invention comprising combinations of T and U shaped conductors. The T and the conductor U are each adjusted according to the principles described with reference to FIGS. 3 and 4. The operations by which the impedance of the U-shaped conductor is adjusted to improve the directional characteristics are as follows:

In the example illustrated by FIG. 5, the windshield 1c comprises a central conductor 13,14 of T shape and a conductor of U shape with two branches 15*a* and 15*b* of the same length. These two conductor (i.e. 13, 14 and 15*a*, 15*b*) are connected to each other at the point of connection 17 situated at the foot of the conductor of T shape, i.e. at the antenna terminal. The geometries of the T and U shaped conductors are symmetrical and the point of connection 17 is exactly at the center. In order to change the impedance of the U shaped conductor, the electrical length of the branch 15*b* is adjusted by means of a capacitance. To this end there is placed in the glass of the windshield or window, and parallel to the branch 15*b*, a conductor 16 connected to the vehicle body by a conductor 18: Insteaad of electrically adjusting a branch of the U-shaped conductor using a capacitance it is possible to lengthen the branch by means of an inductance.

Figure 6:
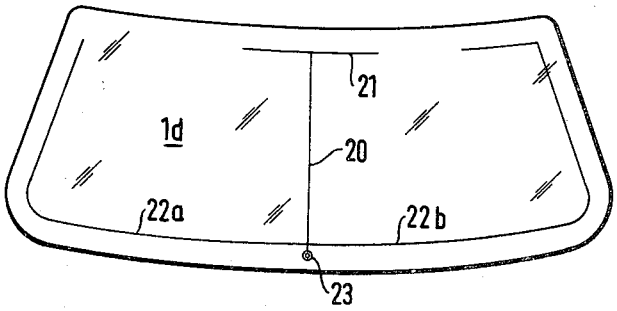

The antenna windshield 1d represented in FIG. 6 is, in conception, analogous to that of FIG. 4. The conductors 20 and the 21 constitute the central conductor in the form of a T and the conductors 22*a* and 22*b* are branches of the U-shaped conductor. The junction of the U and T shaped conductors, which also constitutes the antenna terminal, is represented by 23. The length of the branch 22*b* is however greater than that of the branch 22*a*. In this way, the junction is electrically displaced relative to the center of the U and there is obtained an optimum adjustment of the impedance which greatly reduces the directional effect of the antenna as a whole.

Figure 7:
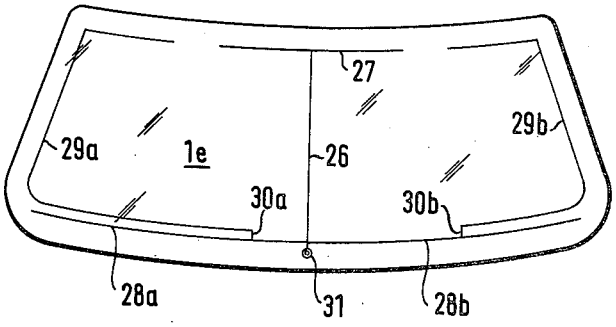

FIG. 7 shows an embodiment of the antenna windshield of the invention in which the T-U assembly is rendered asymmetric by means of conductors branching from the U. The T shaped conductor is composed of a vertical branch 26 and a horizontal branch 27. Parallel to the lower edge of the windshield or window 1*e* there is provided a horizontal conductor of which the two branches 28*a* and 28*b* have the same length. The antenna further comprises two branch conductors 29*a* and 29*b* of U shape, which are connected to conductors 28*a* and 28*b* by bridges 30a and 30b positioned asymmetrically in relation to the junction of conductor 26 with conductors 28*a* and 28*b* to obtain the optimum impedance giving the best directional characteristics. The junction point, which also constitutes the antenna terminal is indicated at 31.

Figure 8:
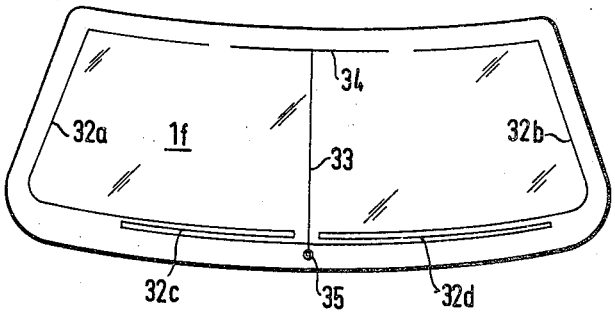

FIG. 8 shows an embodiment in which the branches 32*a* and 32*b* of the conductor of U shape are provided, at their parts adjacent the lower edge of the windshield, with zig-zag portions 32*c* and 32*d* of different lengths. This produces the same effect as described above. The central conductor again comprises conductors 33 and 34 forming a T. The coaxial cable joining the antenna to the receiver is connected at the junction point 35 of the U and T shaped conductors.

Figure 9:
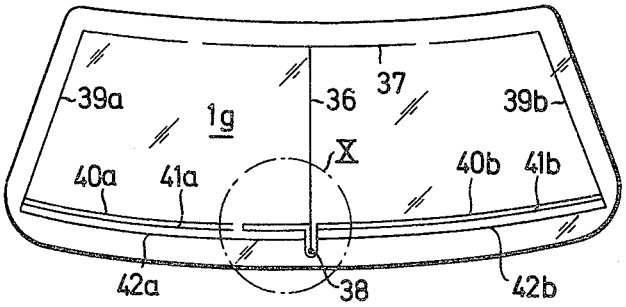
Figure 10:
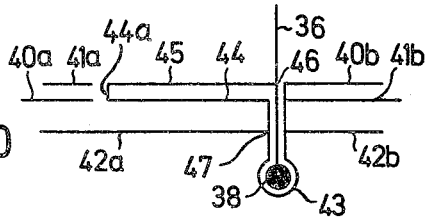
FIG. 10 is a schematic diagram of part of the antenna circuit in the embodiment of FIG. 9.

FIGS. 9 and 10 illustrate still another embodiment of the invention. In FIG. 9, the T-shaped conductor comprises a vertical portion 36 and a horizontal portion 37, the antenna terminal 38 being located at the lower end of the vertical portion 36. The U-shaped conductor comprises two branches 39*a* and 39*b*. These include respectively along the lower edge of the window or windshield a conductor 42a and a conductor 42*b*. These are associated respectively in arrangements of three parallel conductors 40*a*, 41*a* and 42*a* for the branch 39*a* and 40*b*, 41*b* and 42*b* for the branch 39l*b*. In the right-hand branch the conductors 40*b*, 41*b* and 42*b* are electrically connected in parallel. Instead however of being connected to the vertical conductor 36, they are passed around it by a lead 43 (FIG. 10) which passes around the antenna terminal 38.

In the left-hand branch the conductors 40*a* and 41*a* are open ended toward the center conductor 36, whereas the conductor 42*a* is connected at 47 to the lead 43. This lead is extended at the conductors 44, 44*a* and 45 into a loop connecting at 46 to the center conductor 36.

The physical aspect of the antenna of FIG. 9 is accordingly symmetric. The embodiment of FIGS. 9 and 10 is fundamentally similar to those previously described in view of the electrical asymmetry which resides in the open ended conductors 40*a*, 41*a* and the loop 44, 44*a* and 45 by comparison with the three electricaly parallel conductors 40*b*, 41*b* and 42*b*. Adjustment or trimming of the antenna is however particularly advantageous in the embodiments of FIGS. 9 and 10 in that to achieve phase concordance it is sufficient to adjust the position of the bridge or junction 44*a* which connects the conductors 44 and 45. In the embodiment of FIG. 8, the optimum asymmetry is found only after successive modifications of the lengths of the two balancing conductors 32*c* and 32*d*.

In general, in antennas according to the invention comprising T- and U-shaped conductors as illustrated in FIGS. 5 to 10, the coupling of the two portions of the antenna by means of a bypass leads to more easily reproduceable results than when separate branch conductors are employed as in FIG. 7, or when a supplementary capacity is employed as in the embodiment of FIG. 5. The reason for this is that use of capacitive elements for phase correction, as in the case of the embodiments of FIGS. 5 and 7, permits phase balancing only over a narrow frequency band in view of the high ratio of reactance to ohmic resistance of such elements. Even a small change in the distance separating the conductors from the edge of the window or windshield can in such systems be disturbing and result in reduced quality of reception. In contrast, when the coupling of the various parts of the antenna is achieved by the introduction of a relatively high ohmic resistance (e.g. about 20 ohms), as in the case of the embodiments of FIGS. 8 to 10, phase concordance is assured over a much wider range of frequencies. Consequently, these embodiments are much less sensitive to variations in the spacing of the conductors from the edge of the window or windshield, i.e. from the car body.

Of course it is not necessary in applying the principle of FIGS. 9 and 10, to provide three conductors disposed parallel to the lower edge of the window or windshield. The connection of one branch of the U to the other by means of a lead passing around the antenna terminal (the loop 43 in FIG. 10) can of course be applied when only one conductor is provided along the lower edge of the window or windshield in place of the three conductors 40*a*, 41*a*, 42*a* and 40*b*, 41*b*, 42*b* of FIG. 9.

Figure 11:
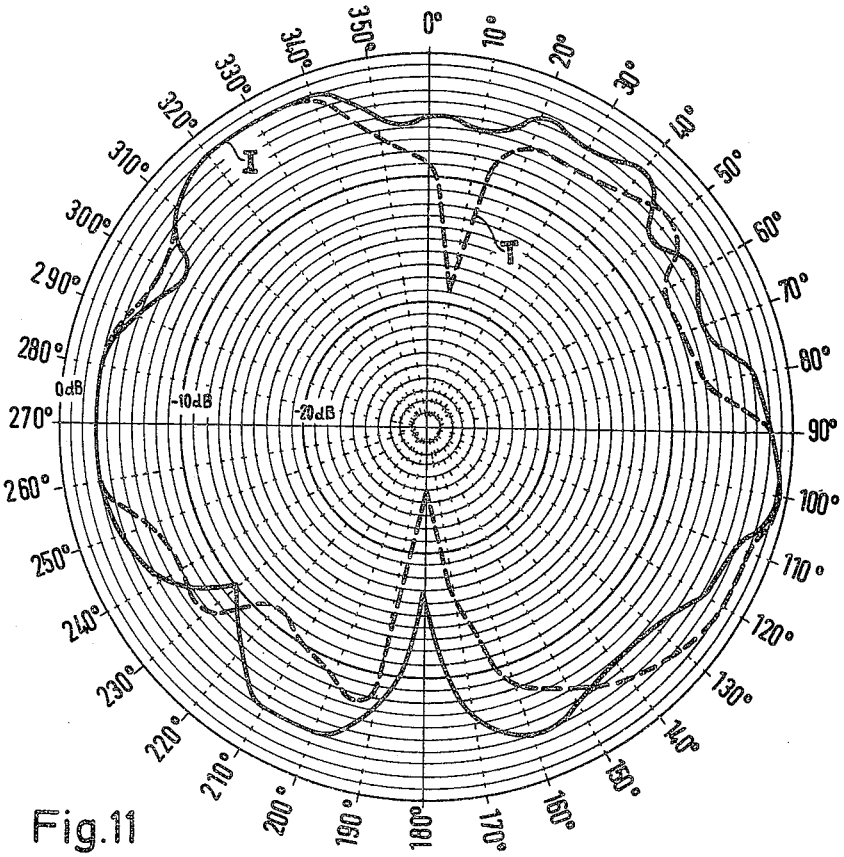
FIG. 11 shows plots of comparative directional diagrams of a known antenna and of an antenna according to the invention.

FIG. 11 shows the results obtained from an antenna according to the invention. Measurements were made with a transmitter at a frequency of 101 megaherz and horizontal polarization of the transmitter. Curve T corresponds to a symmetrical configuration of the T-shaped conductor. Curve I corresponds to an antenna according to FIG. 4 in which there is added to the T an asymmetric horizontal conductor parallel to the lower edge of the window or windshield. The minima appearing to curve V of FIG. 1 for orientations of the car parallel and anti-parallel to the direction from the location of the car to the location of the transmitter have almost completely disappeared. The minimum for the anti-parallel orientation (car pointing away from the transmitter) still exists, but its value is increased by 8 db. This minimum is very difficult to remove because the bodywork plays, in this position, the role of a screen between the transmitter and the antenna. This diagram shows that the mean level of the antenna voltage for the antenna of the invention has been raised by a value corresponding to about 3 db.

With the exception of the embodiment shown in FIG. 5, all of the conductors of the embodiments described employ parts thereof to contribute to correct the directional effect. However, in connection with FIG. 5, it is to be noted that discrete reactances can be used for obtaining asymmetry and that the same effects can be obtained by varying the inductance or the capacitance.

The object of the invention is essentially that the field existing in the vicinity of the window or windshield is to be received by two orthogonal conductors so as to provide an antenna having good directional characteristics by adjustment of the respective impedances of those conductors.

While the invention has been hereinabove described in terms of an antenna incorporated into the windshield of an automotive vehicle, the invention can of course find application in any window of such a vehicle.

Reference has also been made to a substantially vertical conductor as one element of the antenna of the invention. In current automobile design, the windshield, and indeed the side and rear windows, are inclined to the vertical at non-negligible angles. The term "substantially vertical" in the appended claims is to be understood as including conductors supported on, or otherwise incorporated into, windshields or other windows so slanted to the vertical.

While the invention has been described hereinabove in terms of a number of presently preferred embodiments, the invention itself is not limited thereto but rather comprehends all modifications of and departures from those embodiments properly falling within the spirit and scope of the appended claims.

I claim:

1. AM-FM window antenna comprising a transparent window, two conductors applied to the window, each of said conductors being adapted to receive amplitude modulated signals having frequencies of the order of 1,000 kilocycles per second and frequency modulated signals havng frequencies of the order of 100 megacycles per second, each of said conductors being moreover tuned for half-wave resonance within the band of said frequency modulated signals, a terminal applied to said window, at least one of said conductors connecting to said terminal on said window, said conductors connecting to each other at a point on said window between and at unlike distances from the ends of one of said conductors, whereby the directivity of said antenna may be optimized.

2. An antenna according to claim 1 wherein said one conductor is of U-shape and the other of said conductors is of T-shape.

3. An antenna according to claim 1 wherein said one conductor is of generally U-shape and includes, on one side of said point, a plurality of parallel connected branches and on the other side of said point a loop and a plurality of open branches substantially collinear with said loop.

* * * * *

UNITED STATES PATENT AND TRADEMARK OFFICE

CERTIFICATE OF CORRECTION

PATENT NO. : 3,971,030

DATED : July 20, 1976

INVENTOR(S) : Gerd Sauer

It is certified that error appears in the above-identified patent and that said Letters Patent are hereby corrected as shown below:

Col. 1, line 39 and line 50, the German patent application number should read -- P. 21 45 968.7 -- .

Col. 2, line 38, "alignement" should read -- alignment -- .

Col. 2, line 58, for "minimum" read -- minima -- .

Col. 3, line 25, for vetical" read -- vertical -- .

Col. 5, line 34, for "Insteaad" read -- Instead -- .

Col. 6, line 18, change "391b" to -- 39b -- .

Col. 7, line 22, for "to curve" read -- in curve -- .

Signed and Sealed this

Twenty-third Day of November 1976

[SEAL]

*Attest:*

RUTH C. MASON
*Attesting Officer*

C. MARSHALL DANN
*Commissioner of Patents and Trademarks*